US005424484A

United States Patent [19]

Chen

[11] Patent Number: 5,424,484

[45] Date of Patent: Jun. 13, 1995

[54] MUSIC BOX TRANSMISSION MECHANISM

[76] Inventor: Yu-Kai Chen, 2F, No. 2, Lane 15, Tai Hsin St., Tan Shui Town, Taipei County, Taiwan, Prov. of China

[21] Appl. No.: 127,144

[22] Filed: Sep. 27, 1993

[51] Int. Cl.[6] ..... G10F 1/06

[52] U.S. Cl. ..... 84/95.1; 84/95.2; 446/298; 40/418

[58] Field of Search ..... 84/94.1, 94.2, 95.1, 84/95.2; 40/411, 418, 419, 420; 146/298

[56] References Cited

U.S. PATENT DOCUMENTS 2,840,949 7/1958 Faulkner ..... 84/95.2

*Primary Examiner*—M. L. Gellner

*Assistant Examiner*—Cassandra Spyrou

[57] ABSTRACT

A music box transmission mechanism comprised of a music box, a shell connected to the casing of the music box on the outside to hold a base frame, a movable plate connected to the base frame by a connector, a link coupled to a rod on one end of the pinned barrel of the music box, a top actuating rod inserted through respective holes on the connector and the base frame and the movable plate and coupled to the link by a coupling shaft, and two swinging rods inserted through respective half-round slots on the base frame into respective holes on the movable plate, whereby the swinging rods are reciprocated vertically as the top actuating rod is turned back and forth horizontally during the operation of the music box.

12 Claims, 16 Drawing Sheets

MUSIC BOX TRANSMISSION MECHANISM

BACKGROUND OF THE INVENTION

The present invention relates to a music box transmission mechanism which comprises two swinging rods and a top actuating rod coupled to the pinned barrel of a music box by a connector, a base frame, movable plate, a coupling shaft, and a link, so that the swinging rods are reciprocated vertically and the top actuating rod is turned back and forth horizontally as the pinned barrel or the music box is activated.

Various music boxes have been disclosed, and have appeared on the market. These music boxes commonly use a clockwork to turn a pinned barrel against a metal comb for reproducing music. A music box may also be decorated with a doll coupled to the pinned barrel so that the doll is turned round and round as the music box reproduces music. However, this monotonous function has little attraction for consumers.

SUMMARY OF THE INVENTION

The object of the present invention is to provide a music box transmission mechanism for driving parts of a doll on a music box which a doll can be multi-functionally maneuvered with 3-dimensional actions as the music box reproduces music mechanically, such as:

- which reciprocates the hands vertically and turns the head back and forth horizontally,
- which turns the hands and head back and forth horizontally,
- which reciprocates one hand vertically and keeps the other hand immovable while turning the head back and forth horizontally,
- which turns the head and one hand back and forth horizontally and keeps the other hand immovable,
- which turns the head and one hand back and forth horizontally while reciprocating the other hand vertically,
- which turns the head and one leg back and forth horizontally and reciprocates the hands vertically,
- which turns the head, hands, and one leg back and forth horizontally,
- which turns the head, one hand, and one leg back and forth horizontally and reciprocates the other and vertically,
- which turns the head and body back and forth horizontally and reciprocates the hands vertically,
- which turns the head, body, and one leg back and forth horizontally and reciprocates the hands vertically.

DETAILED DESCRIPTION OF THE PREFERRED EMBODIMENTS

Figure 1:
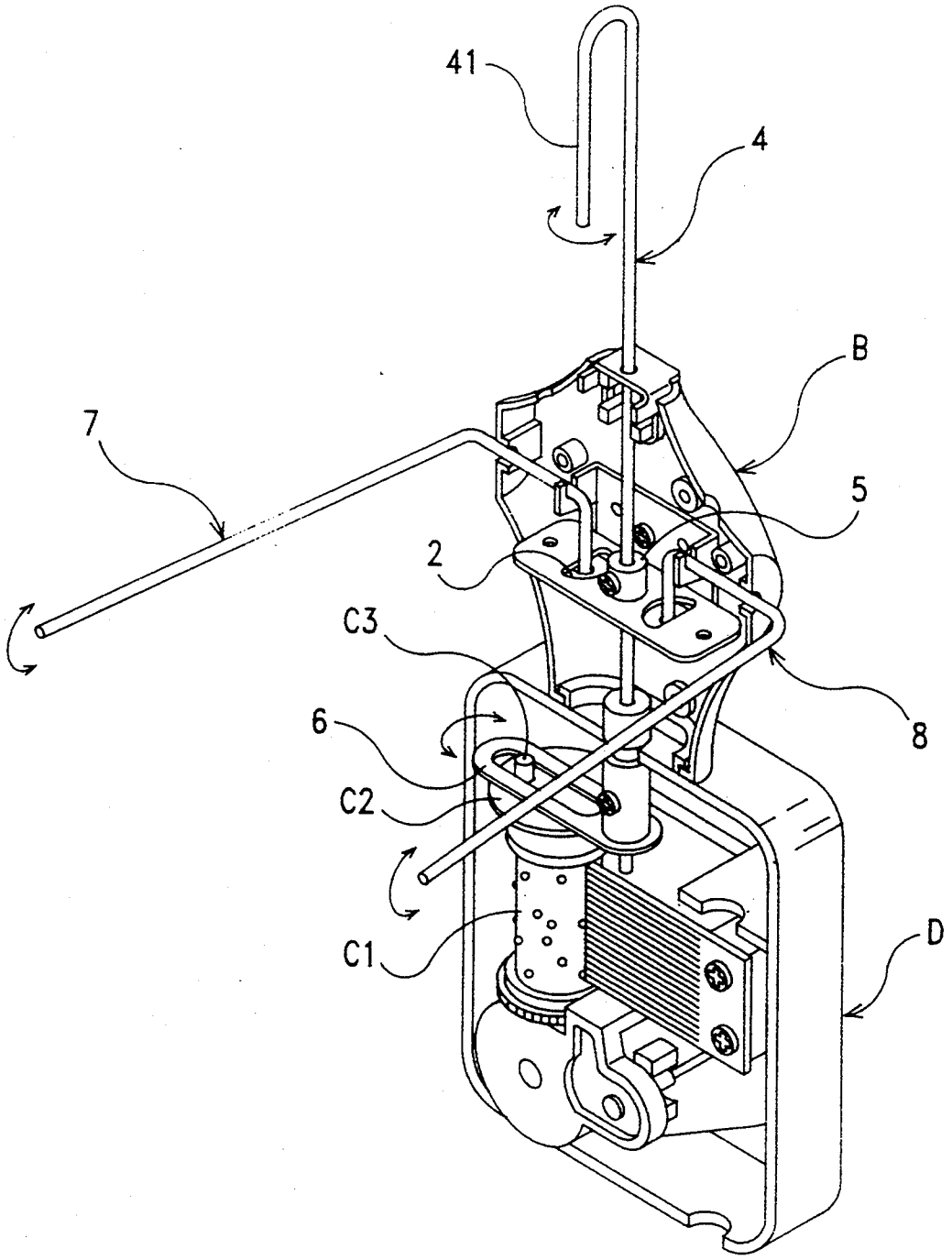
FIG. 1 is an elevational view of a music box transmission mechanism made according to the first embodiment of the present invention.
Figure 2:
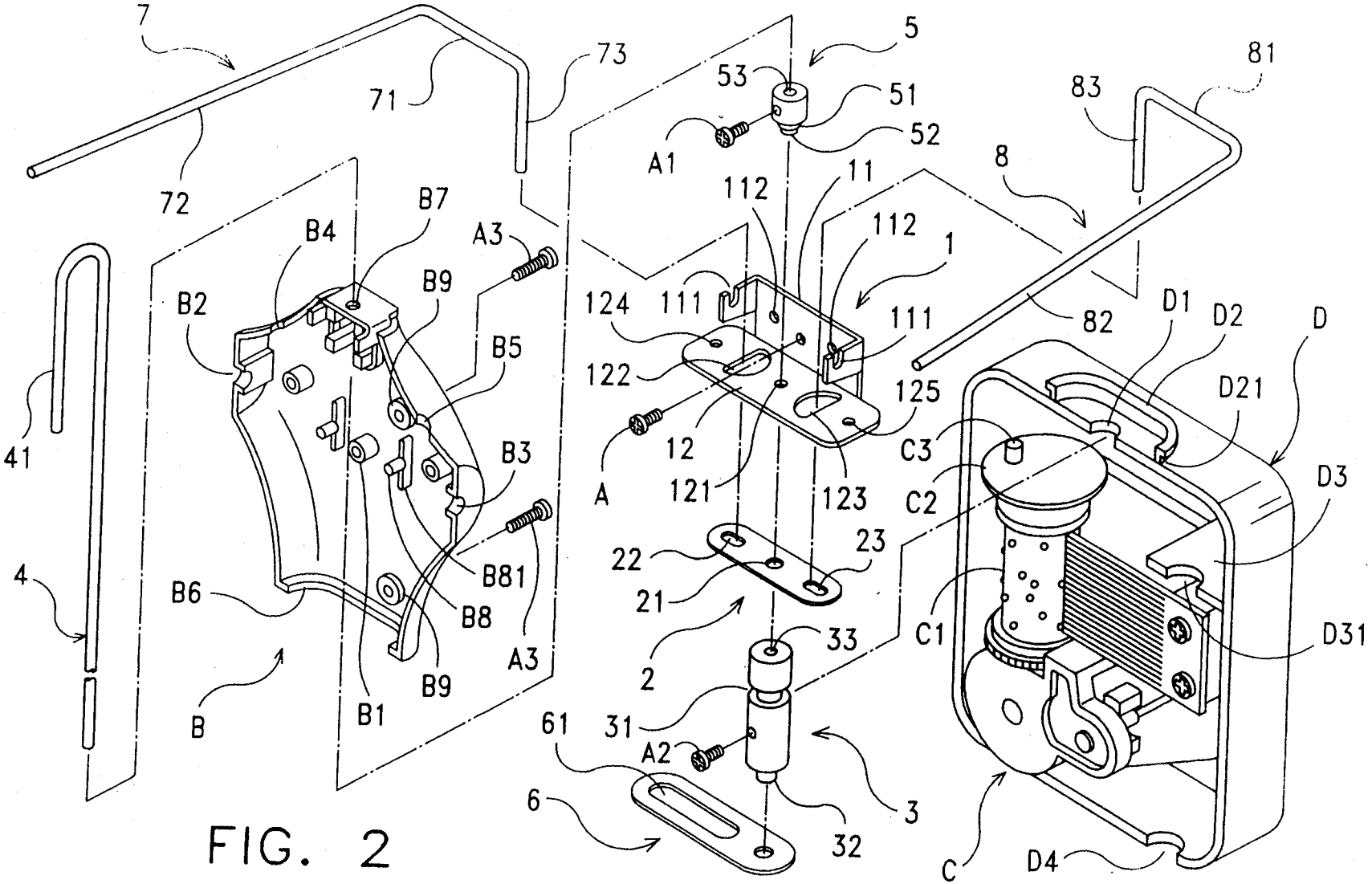
FIG. 2 is an exploded view of the music box transmission mechanism of FIG. 1.

Referring to FIGS. 1 and 2, therein illustrated is a music box transmission mechanism in accordance with the present invention which is generally comprised of a base frame 1, a movable plate 2, a coupling shaft 3, a top actuating rod 4, a connector 5, a link 6, a shell B, a music box C, a right swinging rod 7, and a left swinging rod 8.

The base frame 1 is made of an angle plate comprised of a horizontal portion 12 and a vertical portion 11 raised along one long side of the horizontal portion 12. The vertical portion 11 of the base frame 1 comprises two round holes 112, into which the stub pins B8 of the shell B fit respectively, and two racks 111 bilaterally disposed on the same side. The horizontal portion 12 of the base frame 1 comprises a circular center hole 121 in the center, two circular side holes 124;125 on two opposite sides, and two half-round slots 122;123 respectively disposed between the center hole 121 and the side holes 124;125. The vertical portion 11 is fastened to a center rod B1 on the shell B by a screw A.

The shell B is made in the shape of the human body, comprising a center rod B1, to which the vertical portion 11 of the base frame 1 is fastened, two upright stub pins B8 on two raised strips B81 symmetrically disposed on two opposite sides by the center rod B1, a plurality of screw holes B9 spaced on the inside around the border, two opposite side notches B2;B3 aligned on two opposite sides thereof, a bottom flange B6, a top round hole B7 on the top thereof in the center, two top notches B4;B5 bilaterally disposed on the top between the top round hole B7 and the side notches B2;B3. By threading screws A3 through screw holes B9 on the shell B into respective screw holes (not shown) on the casing D of the music box C, the shell B is fastened to the casing D of the music box C.

The movable plate 2 is made from a flat, oblong plate having a circular center hole 21 aligned with the circular center hole 121 on the horizontal portion 12 of the base frame 1, and two oblong side holes 22;23 disposed on two opposite sides by the circular center hole 121 and respectively aligned with the half-round slots 122;123.

The coupling shaft 3 comprises an annular groove 31 fitted with a top notch D1 within a top flange D2 on the casing D of the music box C, a bottom rod 32 connected to one end of the link 6, a center through hole 33 through the central axis thereof.

The connector 5 comprises a center through hole 53 through the longitudinal axis thereof, a stepped bottom rod formed a thicker rod section 51 and a thinner rod section 52 extended downward from the thicker rod section 51. The thicker rod section 51 is fitted into the center round hole 121 on the horizontal portion 12 of the base frame 1 for allowing the thinner rod section 52 to be inserted into the center hole 21 on the movable plate 2. The diameter of the center hole 21 of the movable plate 2 is bigger than that of the thinner rod section 52, therefore the movable plate 2 can be turned on the thinner rod section 52.

The link 6 is made of a flat, elongated plate having one end connected to the bottom rod 32 of the coupling shaft 3 and an opposite end made with an elongated slot 61 mounted on a rod C3 on a disk C2 on one end of the pinned barrel C1 of the music box C.

The casing D of the music box C comprises a top flange D2, a top notch D1, which receives the annular groove 31 of the coupling shaft 3, an outer groove D21 along the top flange D2, into which the bottom flange B6 fits, an inside bearing plate D3 with a front notch D31, and a bottom notch D4.

The top actuating rod 4 has one end formed into a top bend 41, and an opposite end inserted in proper order through the top round hole B7 on the shell B, the center through hole 53 on the connector 5, the center through hole 33 on the coupling shaft 3, to connect the link 6, the coupling shaft 3, the movable plate 2, the base frame 1, and the connector 5 together. After the top actuating rod 4 was inserted through the center through hole 53 on the connector 5 and the center through hole 33 on the coupling shaft 3, it is fastened to the connector 5 and the coupling shaft 3 by respective tightening up screws A1;A2.

The right swinging rod 7 is comprised of a first horizontal rod portion 71, a second horizontal rod portion 72 extended from one end of the first horizontal rod portion 71 at right angles on the same horizontal plane, and a vertical rod portion 73 vertically extended from an opposite end of the first horizontal rod portion 71. The first horizontal rod portion 71 is mounted on the right-hand rack 111 of the vertical portion 11 of the base frame 1 and the right-hand side notch B2 of the shell B.

Similar to the right swinging rod 7, the left swinging rod 8 is comprised of a first horizontal rod portion 81, a second horizontal rod portion 82 extended from one end of the first horizontal rod portion 81 at right angles on the same horizontal plane, and a vertical rod portion 83 vertically extended from an opposite end of the first horizontal rod portion 81. The first horizontal rod portion 81 of the left swinging rod 8 is mounted on the left-hand rack 111 of the vertical portion 11 of the base frame 1 and the left-hand side notch B3 of the shell B.

Referring to FIG. 1 again, as the pinned barrel C1 is activated by the clockwork, the rod C3 of the disk C2 is turned to reciprocate the link 6. As the link 6 is reciprocated, the top actuating rod 4 is simultaneously moved to turn the movable plate 2 back and forth, and therefore the swinging rods 7;8 are alternatively turned back and forth to simulate the action of a lay in walking, the action of a solder in beating a drum, or the action of a little girl in playing a piano.

Figure 3:
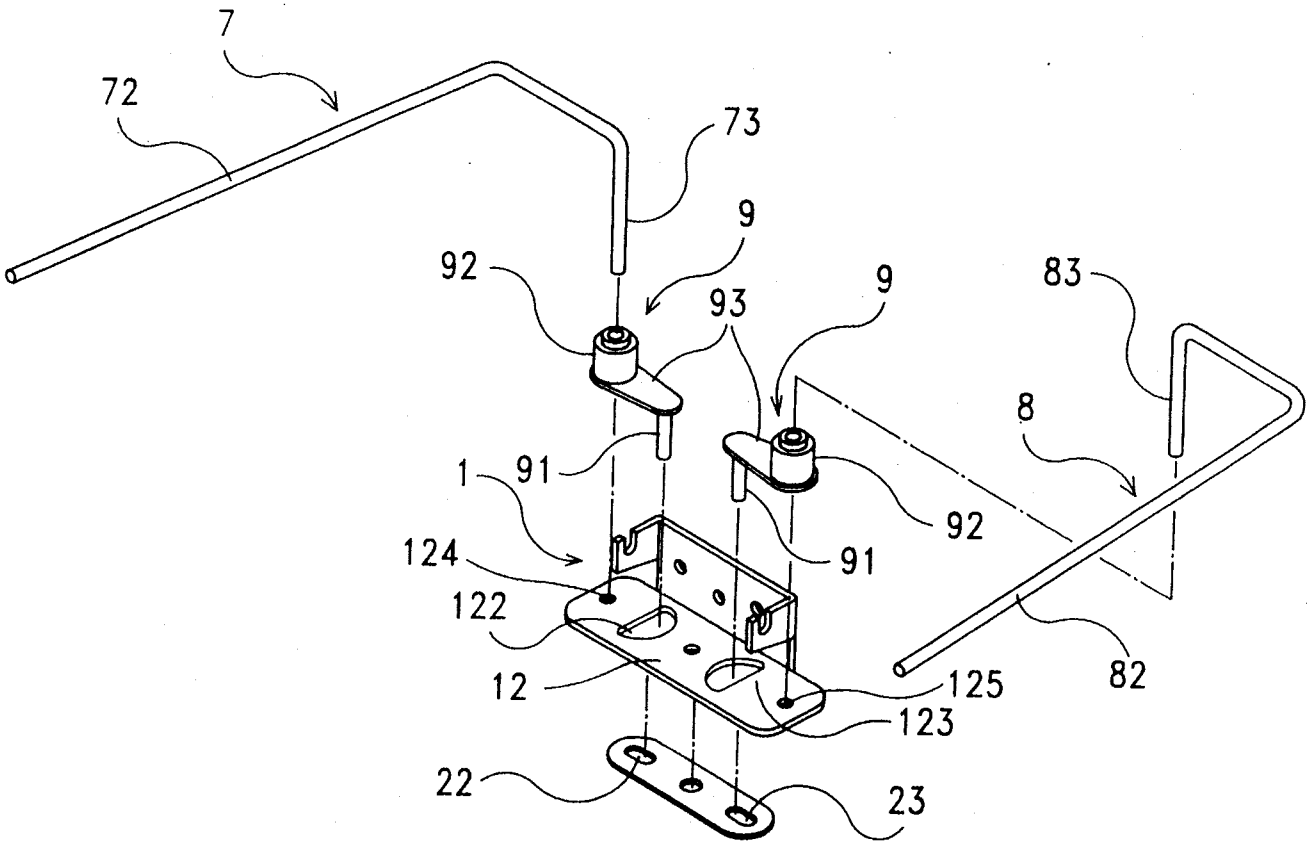
FIG. 3 is an exploded view showing two cranks provided for connecting two swinging rods to a base frame and a movable plate.
Figure 3A:
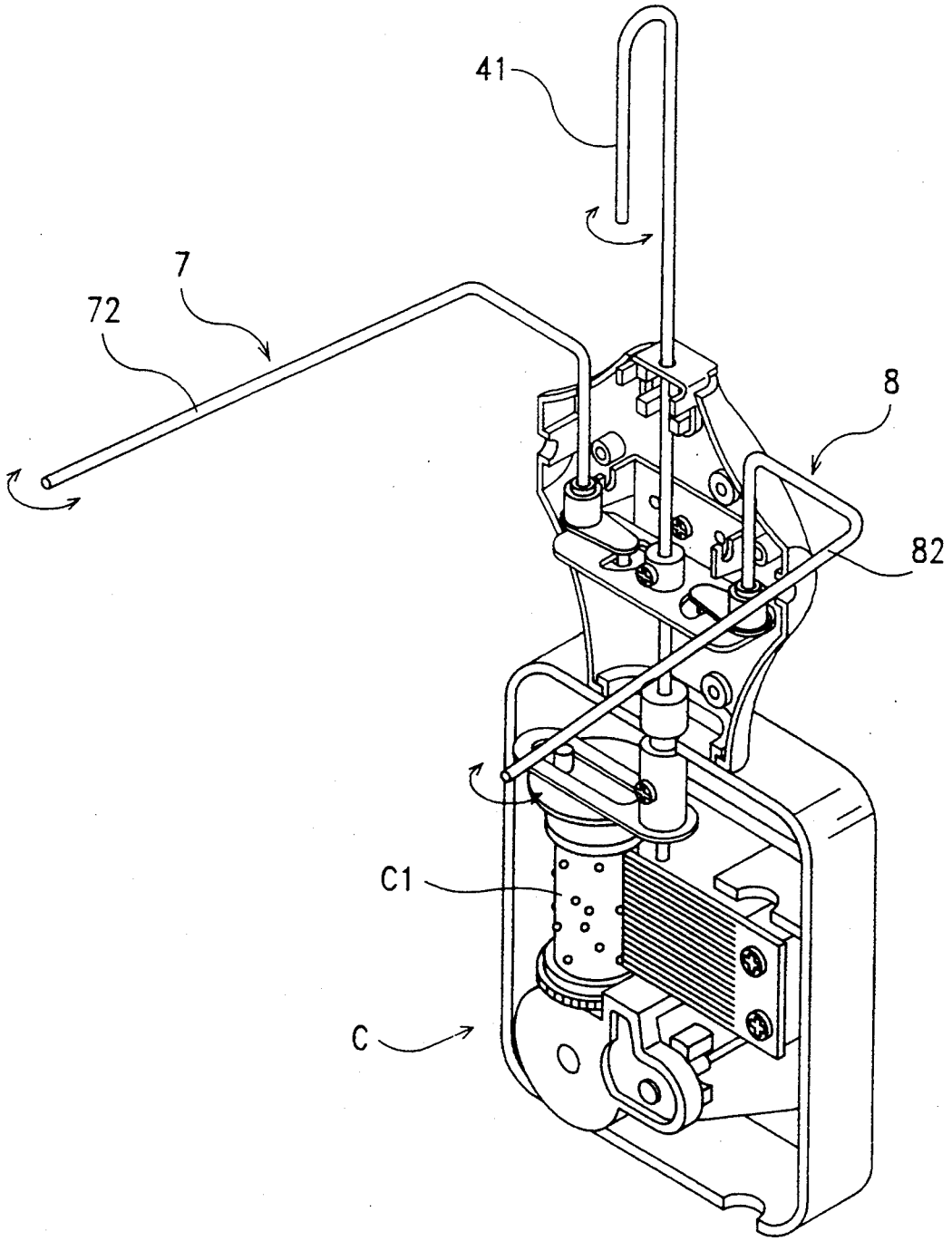
FIG. 3A is an elevational view of an alternate form of the present invention, showing the swinging rods and tile top actuating rod turned back and forth horizontally during the operation of the music box.

Referring to FIGS. 3 and 3A, therein illustrated is an alternate form of the present invention. In this alternate form, two cranks 9 are additionally provided while the other parts remained unchanged. The cranks 9 are fastened to the base frame 1 and the movable plate 2 to hold the right and left swinging rods 7;8 for permitting the right and left swinging rods 7;8 to be turned back and forth horizontally. The crank 9 comprises a horizontal plate 93 in the middle, a bottom rod 91 vertically downwardly extended from one end of the horizontal plate 93 and inserted either half-round slot 122 or 123 on the horizontal portion 12 of the base frame 1 into the corresponding side hole 22 or 23 on the movable plate 2, and a top stub tube 92 vertically upwardly extended from the opposite end of the horizontal plate 93. The vertical rod portion 73 or 83 of the swinging rod 7 or 8 is inserted through the top stub tube 92 into the respective side hole 124 or 125 on the horizontal portion 12 of the base frame 1. As the pinned barrel C1 of the music box C is turned round and round, the second horizontal rod portion 72 or 82 is turned back and forth horizontally to simulate the action of a standing or sitting girl in playing a garland or piano.

Figure 4:
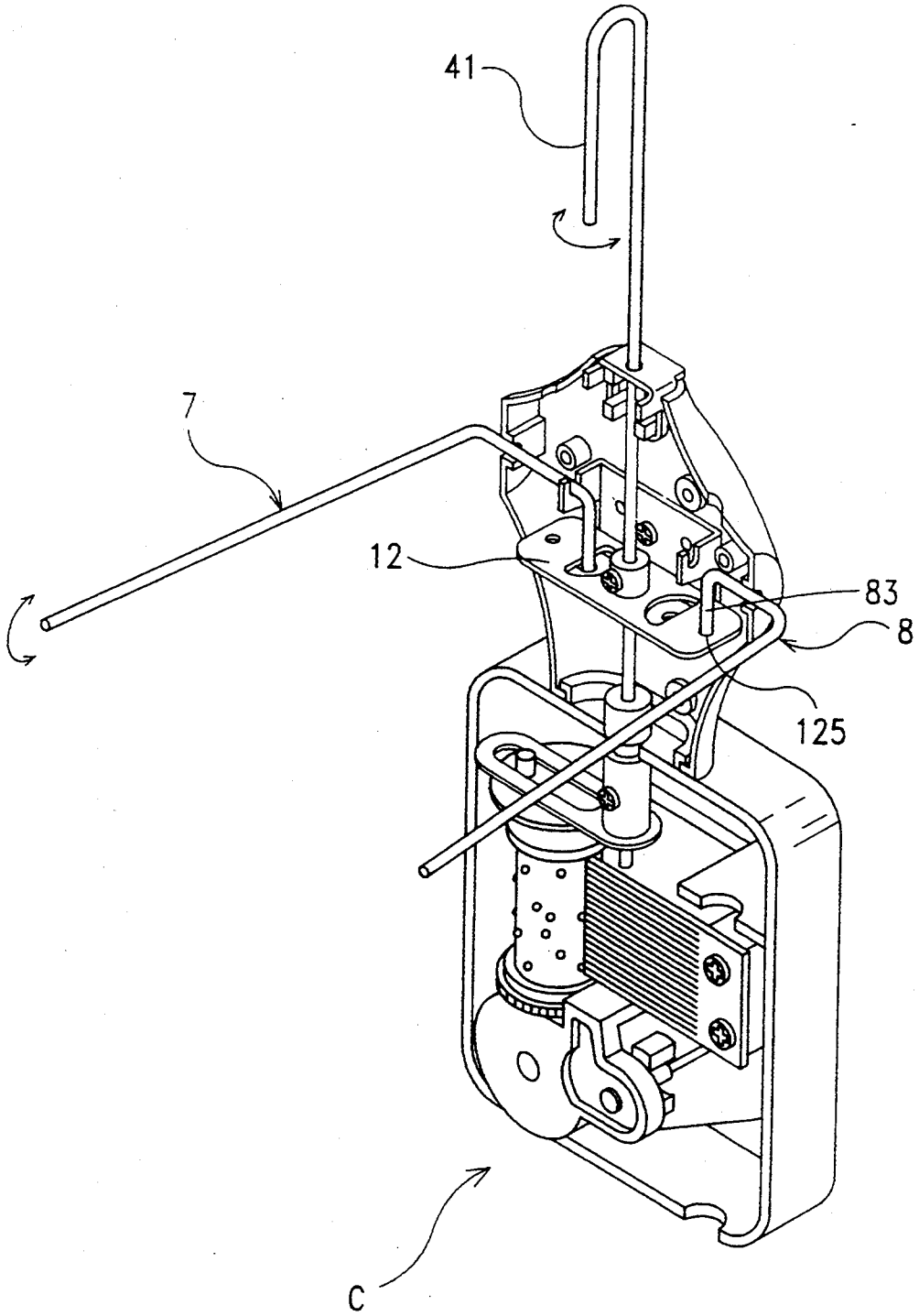
FIG. 4 is an elevational view of another alternate form of the present invention, showing the left swinging rod immovable, the right swinging rod reciprocated vertically, and the top actuating rod turned back and forth horizontally.

Referring to FIG. 4, therein illustrated shows an alternative arrangement of the embodiment FIG. 1. By inserting the vertical rod portion 83 the left swinging rod 8 in the respective side hole 125 on the horizontal portion 12 of the base frame 1, the left swinging rod 8 is maintained immovable as the right swinging rod 7 is reciprocated vertically during the operation of the music box C, and therefore the mechanism can simulate the action of a little girl in holding a pet with left hand and petting the pet with the right hand.

Figure 5:
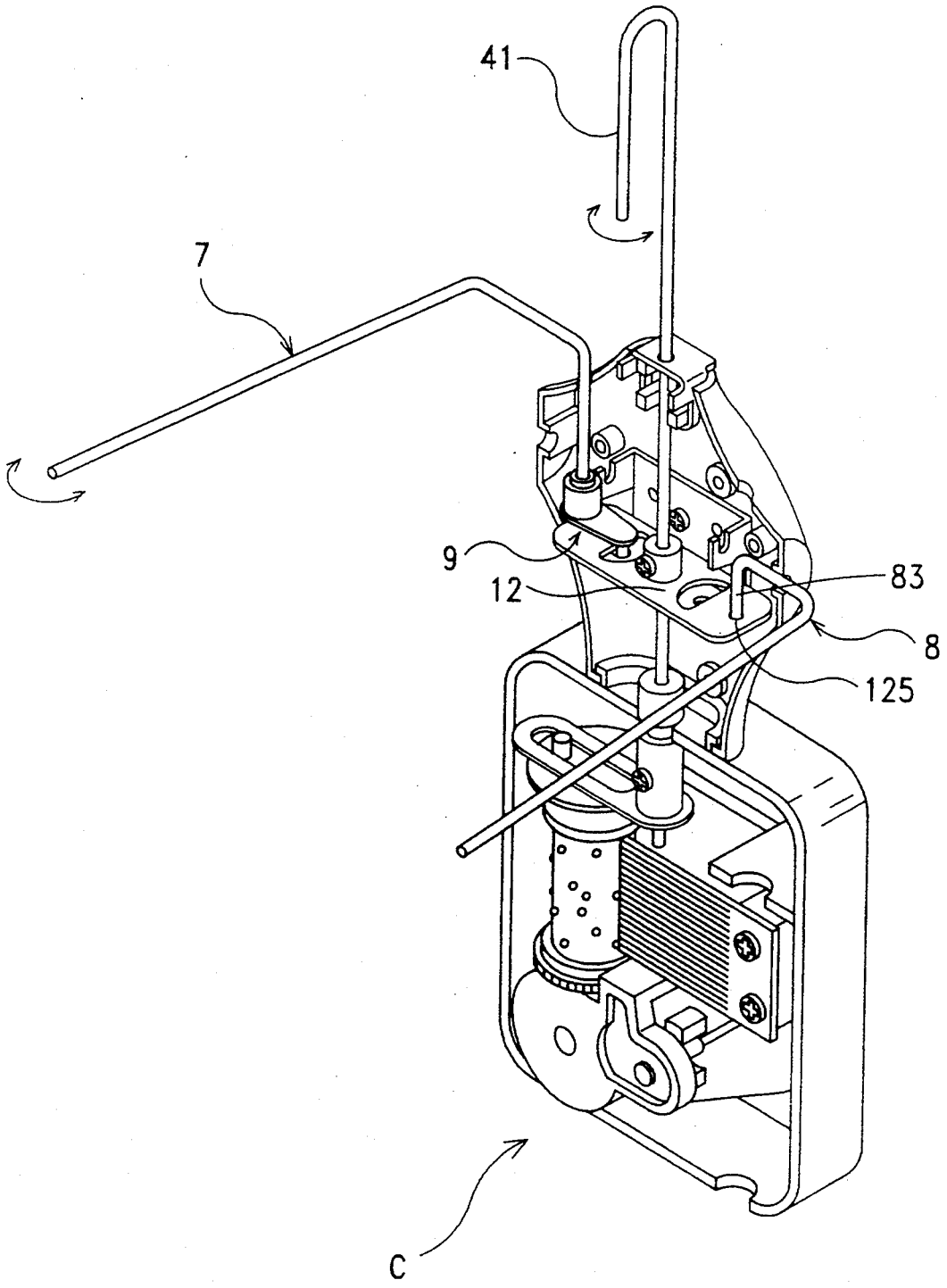
FIG. 5 is an elevational view of still another alternate form of the present invention, showing the left swinging rod immovable, the right swinging rod and the top actuating rod turned back and forth horizontally.

Referring to FIG. 5, therein illustrated snows another alternate form of the present invention. By inserting the vertical rod portion 83 of the left swinging rod 8 in the respective side hole 125 on the horizontal portion 12 of the base frame 1 respectively and connecting the right swinging rod 7 to the base frame 1 by a crane 9, the right swinging rod 7 is turned back and forth horizontally as the left swinging rod 8 is maintained immovable during the operation of the music box C, and therefore the mechanism can simulate the action of a standing or sitting young child in playing a violin or the like.

Figure 6:
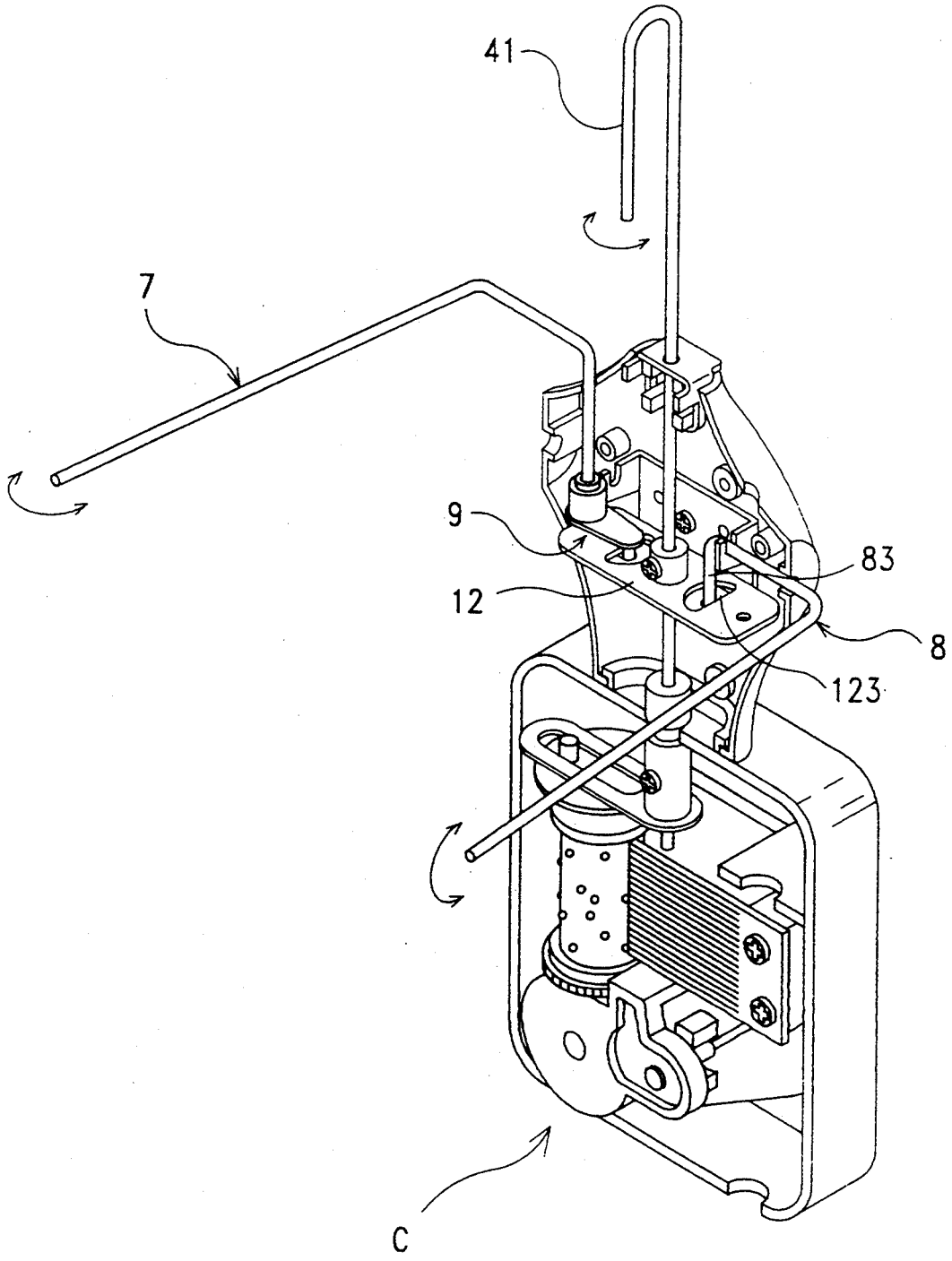
FIG. 6 is an elevational view of still another alternate form of the present invention, showing the left swinging rod reciprocated vertically, the right swinging rod and the top actuating rod turned back and forth horizontally.

Referring to FIG. 6, therein illustrated shows still another alternate form of the present invention. By connecting the right swinging rod 7 to the base frame 1 by a crank 9 and inserting the vertical rod portion 83 of the left swinging rod 8 in the respective half-round slot 123 on the horizontal portion 12 of the base frame 1, the right swinging rod 7 is turned back and forth horizontally as the left swinging rod 8 is reciprocated vertically during the operation of the music box C, and therefore the mechanism can simulate the action of a standing or sitting young child in playing an organ or clapping the hands.

Figure 7:
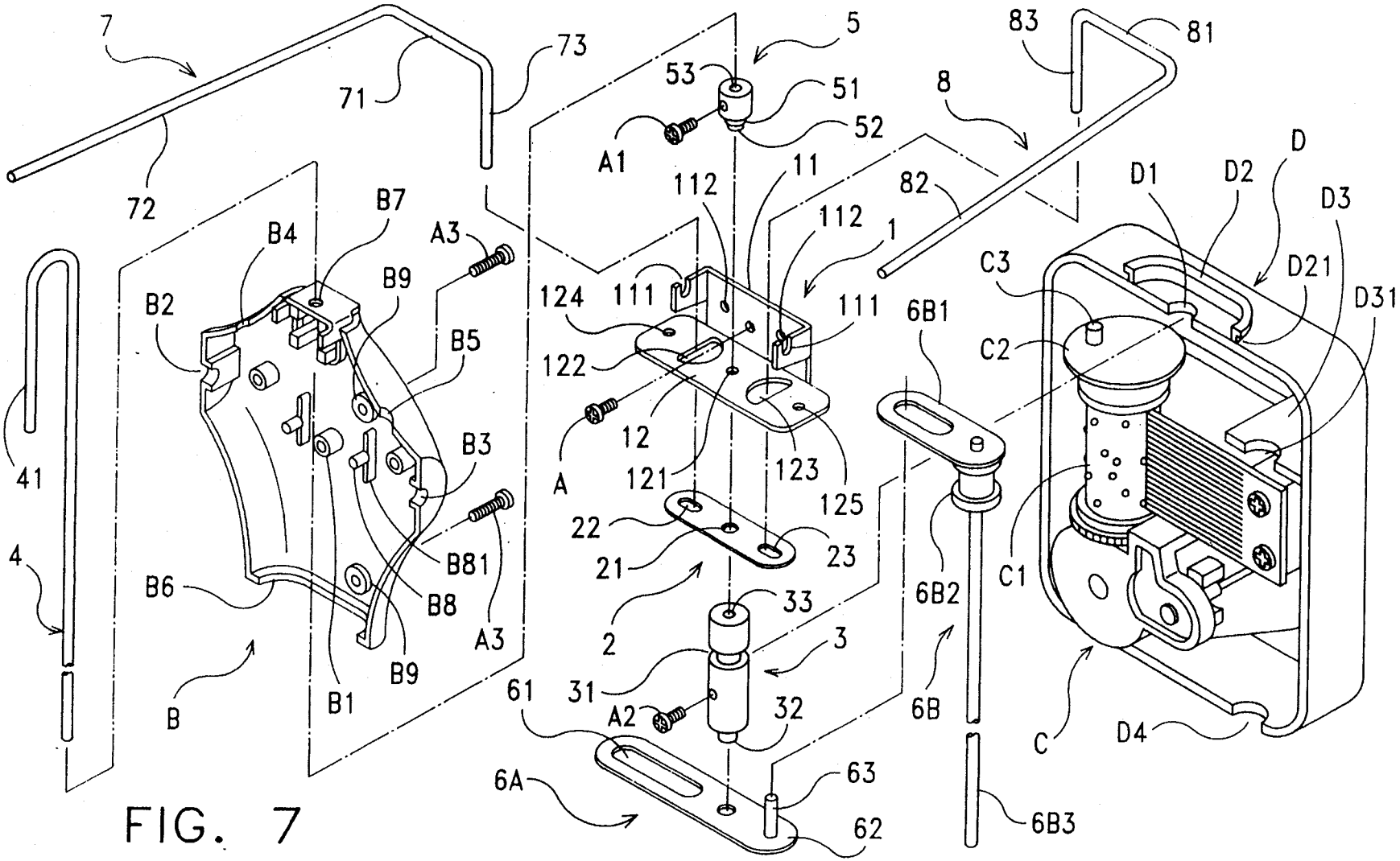
FIG. 7 is an exploded view of still another alternate form of the present invention.
Figure 7A:
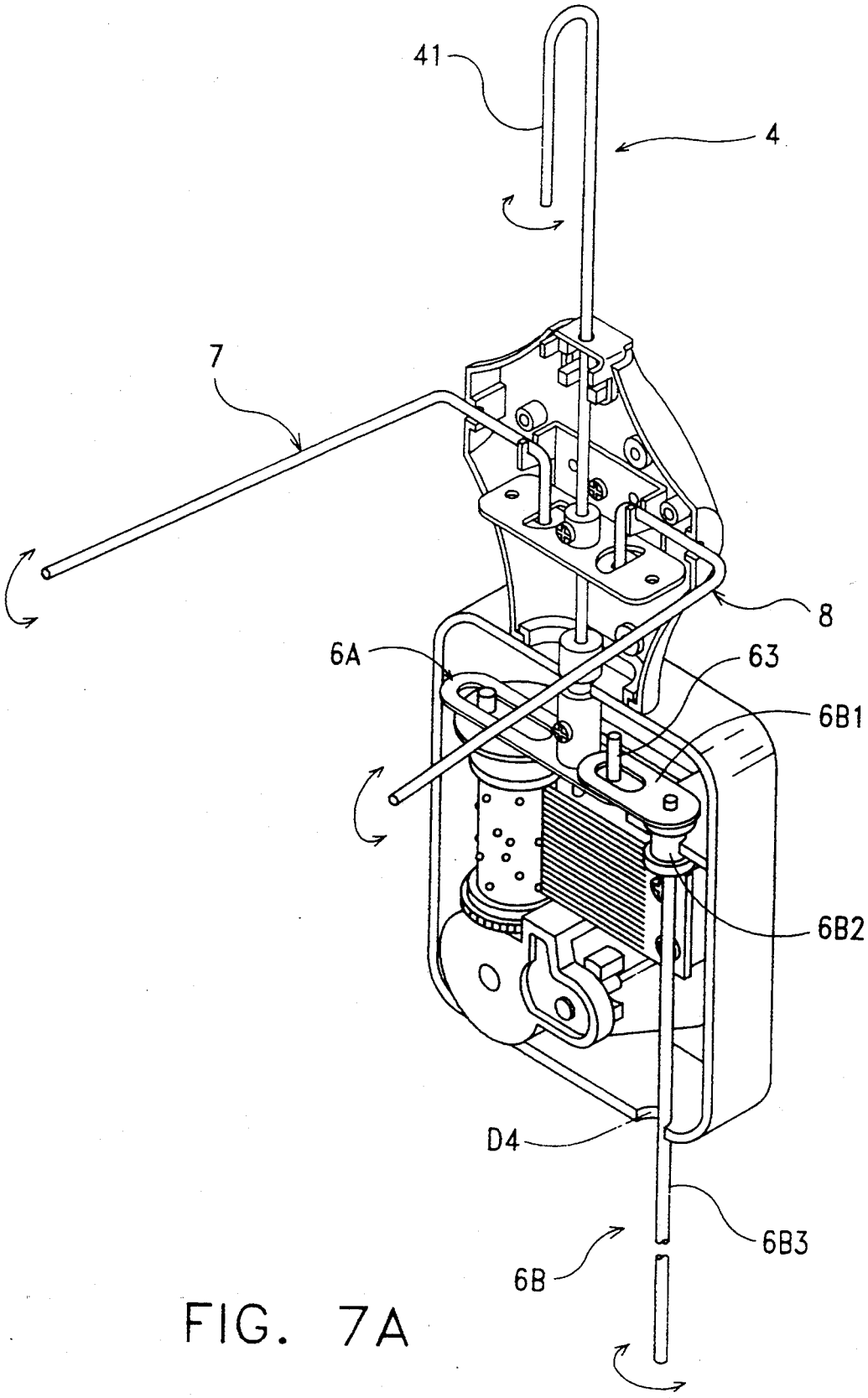
FIG. 7A is an elevational view of the music box transmission mechanism of FIG. 7, showing the top and bottom actuating rods turned back and forth horizontally, the right and left swinging rods reciprocated vertically.

Referring to FIGS. 7 and 7A, therein illustrated is still another alternate form of the present invention. In this alternate form, the link which is referenced by 6A is different in structure from the link 6 shown in FIGS. 1 through 6. The link 6A is made from a flat, elongated plate having a middle part connected to the bottom rod 32 of the coupling shaft 3, an elongated slot 61 on one end mounted on the rod C3 of the disk C2 of the music box C, and an upright rod 63 on an opposite end at the top. The bottom actuating rod 6B is comprised of an oval open plate 6B1 disposed in a horizontal position and mounted around the upright rod 63 of the link 6A, an elongated rod 6B3 extended out of the music box C through the bottom notch D4 of the casing D, and a neck 6B2 connected between the elongated rod 6B3 and the one end of the oval open plate 6B1 and engaged in the top notch D1 of the casing D. As the swinging rods 7;8 are reciprocated vertically and the top actuating rod 4 is turned back and forth horizontally, the bottom actuating rod 6B is simultaneously turned back and forth horizontally, and therefore the mechanism can simulate the action of a dancer in turning the left leg back and forth on the ground and the moving the hands up and down.

Figure 7B:
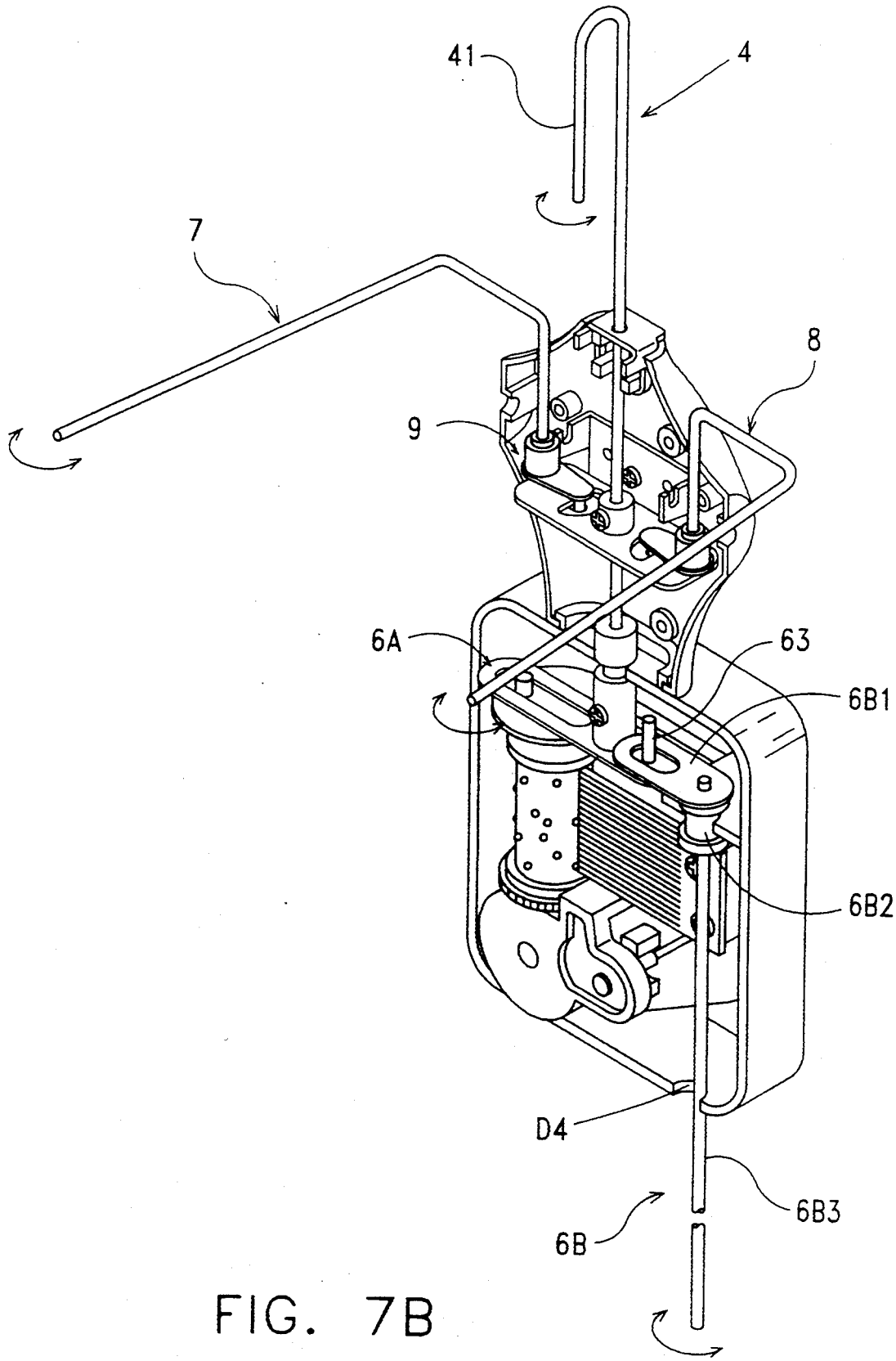
FIG. 7B is an elevational view of still another alternate form of the present invention, showing the top and bottom actuating rods and the right and left swinging rods respectively and horizontally turned back and forth.

Referring to FIG. 7B, therein illustrated shows another alternate form of the music box transmission mechanism of FIG. 7. In this alternate form, two cranks 9 are installed to connect the right swinging rod 7 and the left swinging rod 8 to the base frame 1 of the music box transmission mechanism of the third embodiment of the present invention, for allowing the swinging rods 7;8 and the top actuating rod 4 to be turned back and forth horizontally as the bottom actuating rod 6B is turned back and forth horizontally during the operation of the music box C, and therefore the mechanism can simulate the action of a dancer in turning the left leg and the hands back and forth horizontally.

Figure 8:
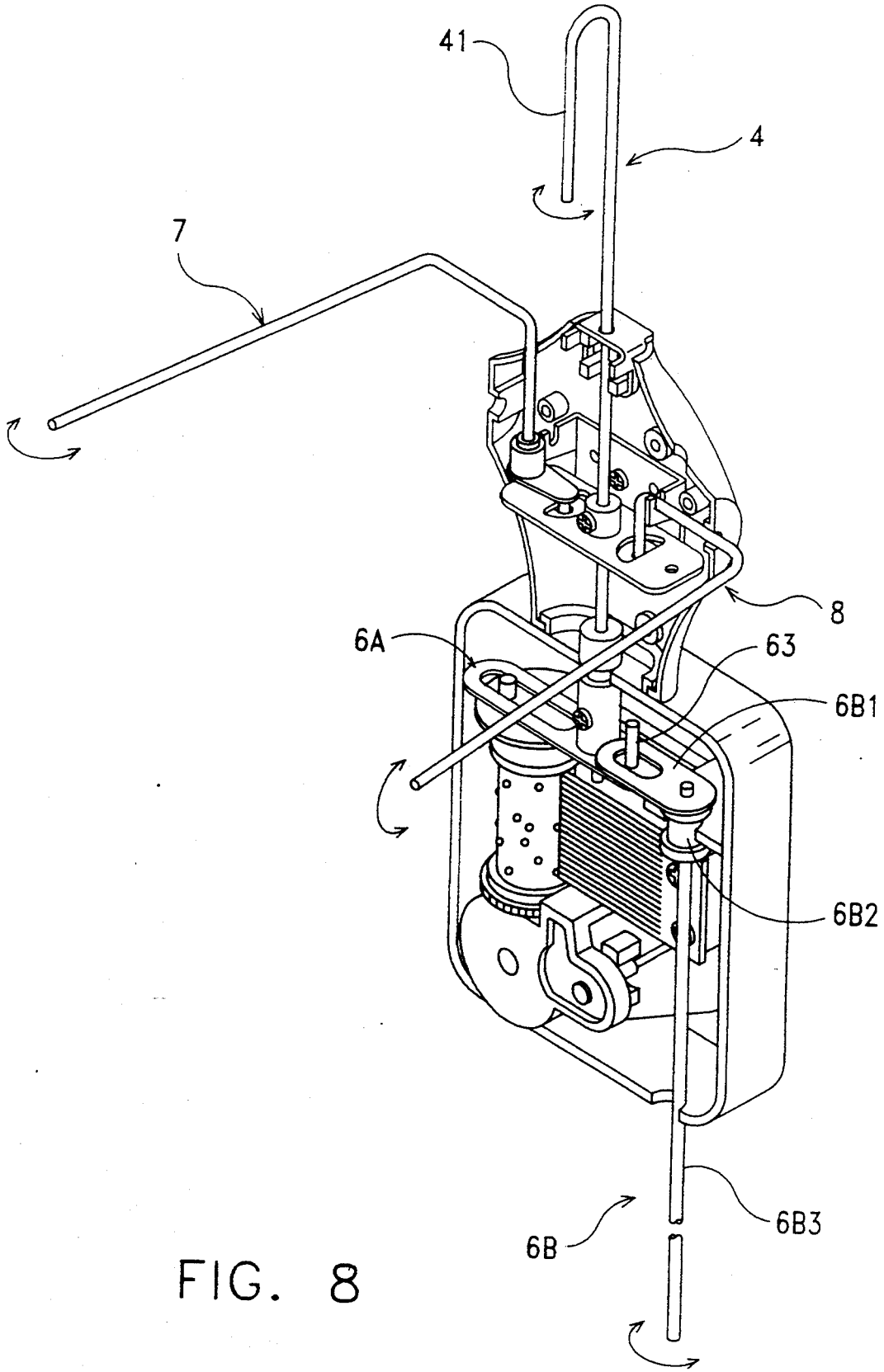
FIG. 8 is an elevational view of still another alternate form of the present invention, showing the left swinging rod reciprocated vertically, the top and bottom actuating rods and the right swinging rod respectively and horizontally turned back and forth.

Referring to FIG. 8, therein illustrated snows still another alternate form of the music box transmission mechanism of FIG. 7. In this alternate form, the left swinging rod 8 is reciprocated vertically as the right swinging rod 7 and the top and bottom actuating rods 4;6B are simultaneously turned back and forth horizontally, and therefore the mechanism can simulate the action of a dancer in turning the left leg, moving the right hand horizontally and the left hand vertically.

Figure 9:
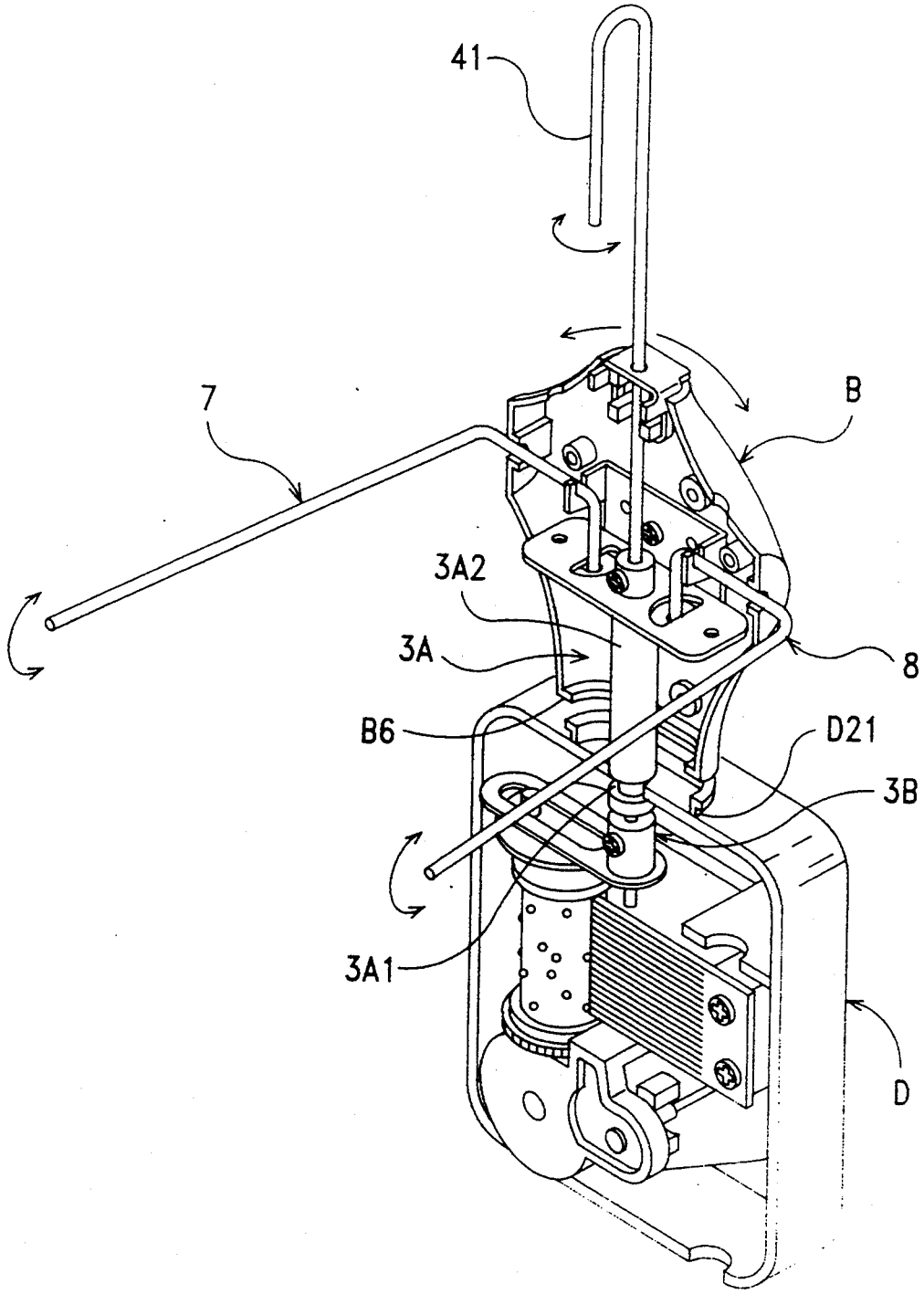
FIG. 9 is an elevational view of still another alternate form of the present invention, showing the top actuating rod and the shell turned back and forth horizontally, the right and left swinging rods reciprocated vertically.
Figure 9A:
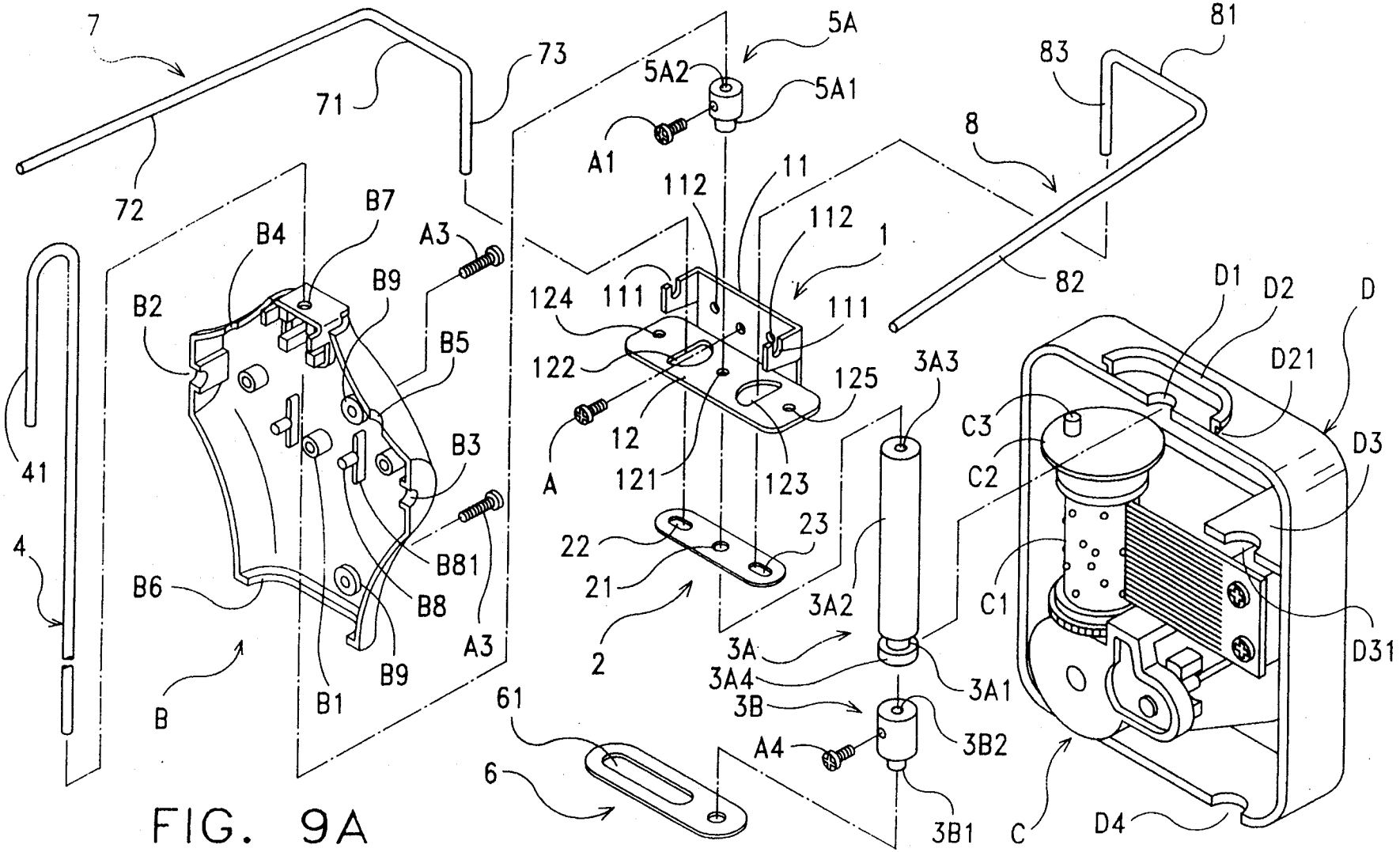
FIG. 9A is an exploded view of still another alternate form of the present invention.

Referring to FIGS. 9 and 9A, therein illustrated is still another alternate form of the present invention. This alternate form is similar to the embodiment shown in FIG. 1. However, the connector as referenced by 5A is different from that as referenced by 5 shown in FIG. 2. Further, an upper coupling shaft 3A and a lower coupling shaft 3B are used in this alternate form to replace the coupling shaft 3 shown in FIG. 2. The connector 5A comprises a uniform bottom rod inserted through the center hole 121 on the horizontal portion 12 of the base frame 1 and the center hole 21 on the movable plate 2, and a center through hole 5A2 through its central axis. The upper coupling shaft 3A comprises an elongated shaft body 3A2, a projecting stub rod 3A4 longitudinally extended from one end of the shaft body 3A2 in line with its central axis and stopped against the bottom rod 5A1 of the connector 5A, an annular groove 3A1 around the shaft body 3A2 near its opposite end for matching with the top notch D1, and a center through hole 3A3 through the central axis thereof. The lower coupling shaft 3B comprises a center through hole 3B2 through the central axis thereof, and a center bottom rod 3B1 connected to one end of the link 6. As the top actuating rod 4 is inserted through the center through hole 5A2 on the connector 5A, the center through hole 3A3 on the upper coupling shaft 3A, and the center through hole 3B2 on the lower coupling shaft 3B, it is tightly fastened to the connector 5A and the lower coupling shaft 3B by respective tightening up screws A1;A4. The arrangement of the upper coupling shaft 3A is to support the shell B, the connector 5A, the base frame 1, and the movable plate 2 on a higher elevation, and therefore the bottom flange B6 is spaced above the top flange D2 for permitting the shell B to be turned back and forth horizontally as the top actuating rod 4 is moved. As the lower coupling shaft 3B is turned back and forth to move the top actuating rod 4, the upper coupling shaft 3A is immovable, the swinging rods 7;8 are respectively and vertically reciprocated, and the shell B is simultaneously and horizontally turned back and forth. Therefore, the mechanism can simulate the action of a lady in walking, or the action of a solder in beating a drum, or the action of a sitting child in playing a piano.

Figure 9B:
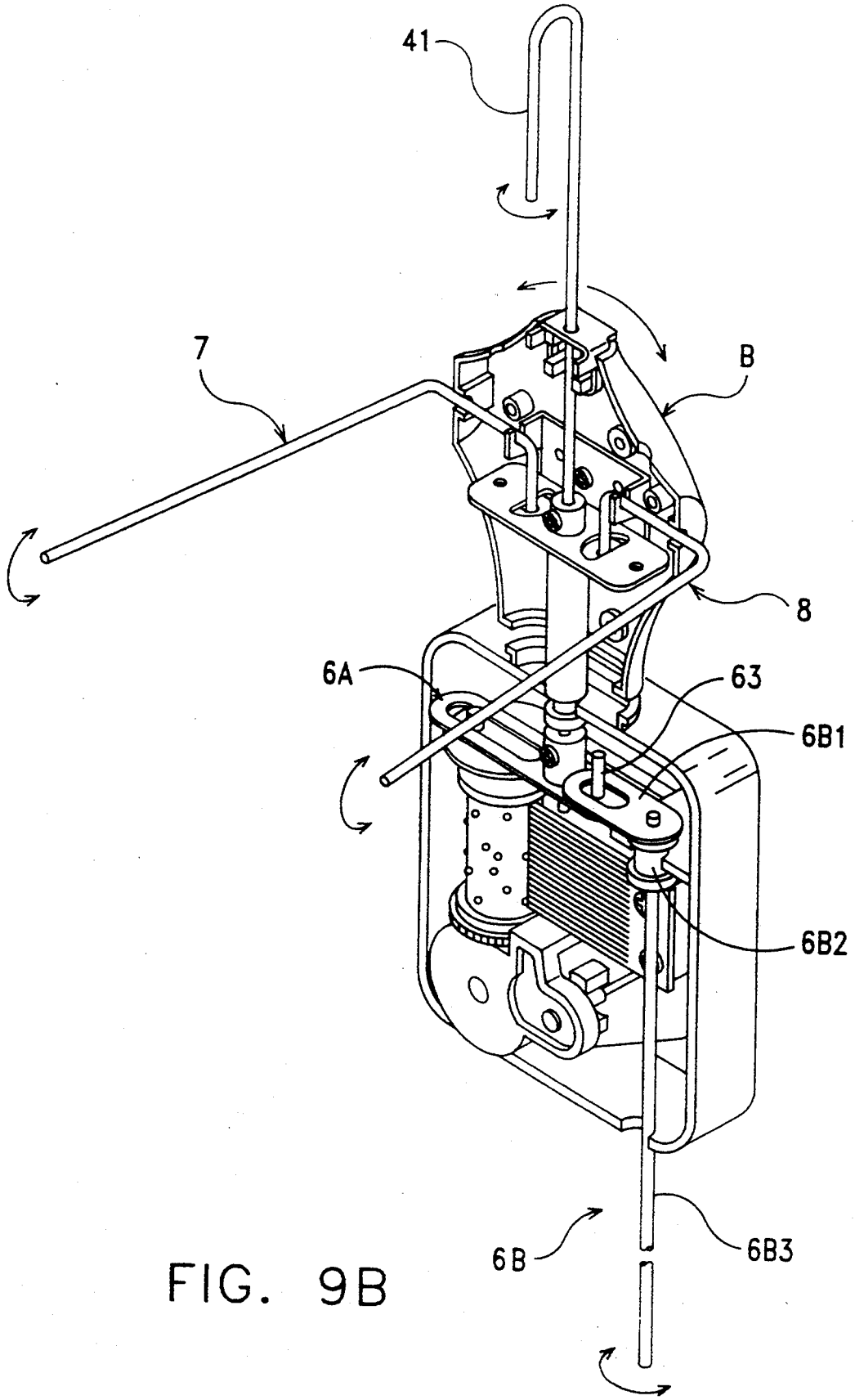
FIG. 9B is an elevational view of the music box transmission mechanism of FIG. 9A, showing the right and left swinging rods reciprocated vertically, the top and bottom actuating rods and the shell turned back and forth horizontally.

Referring to FIG. 9B, therein illustrated is still another alternate form the present invention. This alternate form is similar to the embodiment shown in FIG. 9, but the link 6A shown in FIG. 7 is used, and an additional bottom actuating rod 6B is installed. As the music box C is activated, the top and bottom actuating rods 4;6B and the shell B are turned back and forth horizontally, and the left and right swinging rods 7;8 are reciprocated vertically. Therefore, the mechanism can simulate the action of a dancer in turning the body and the left leg and moving the hands up and down.

Figure 10:
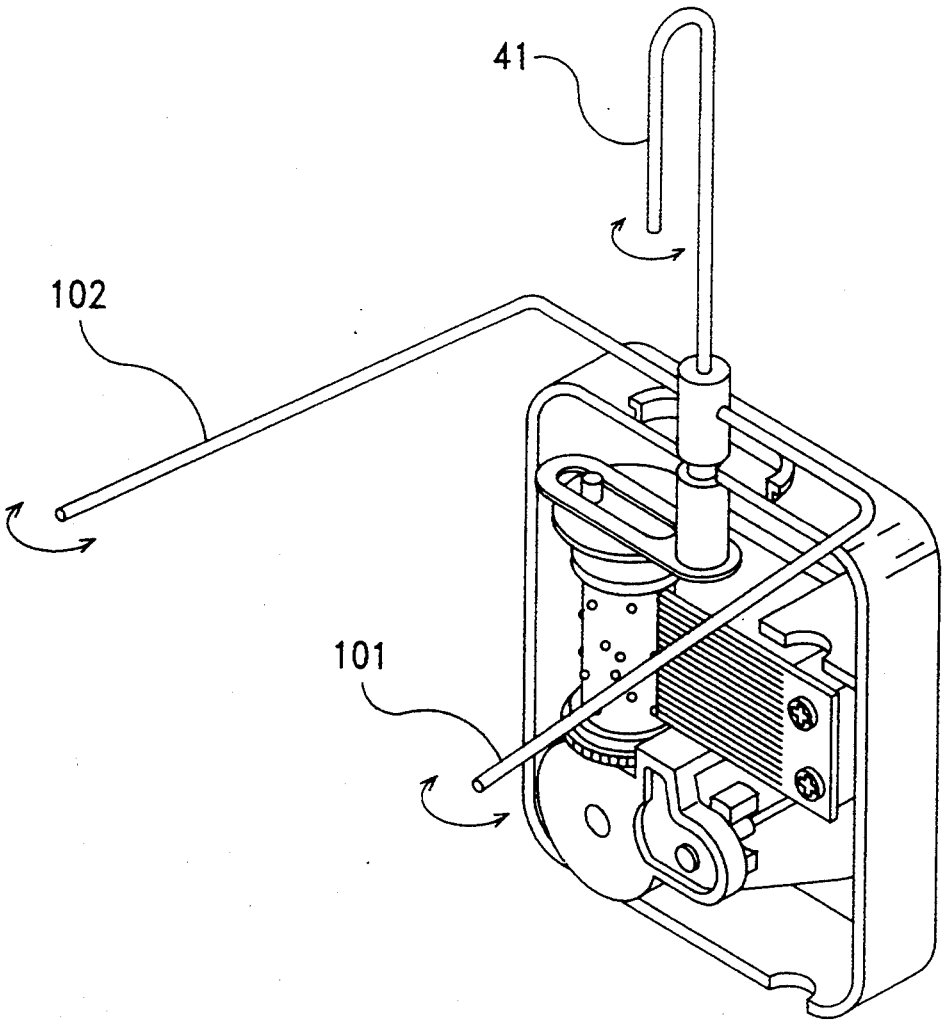
FIG. 10 is an elevational view of still another alternate form of the present invention.
Figure 10A:
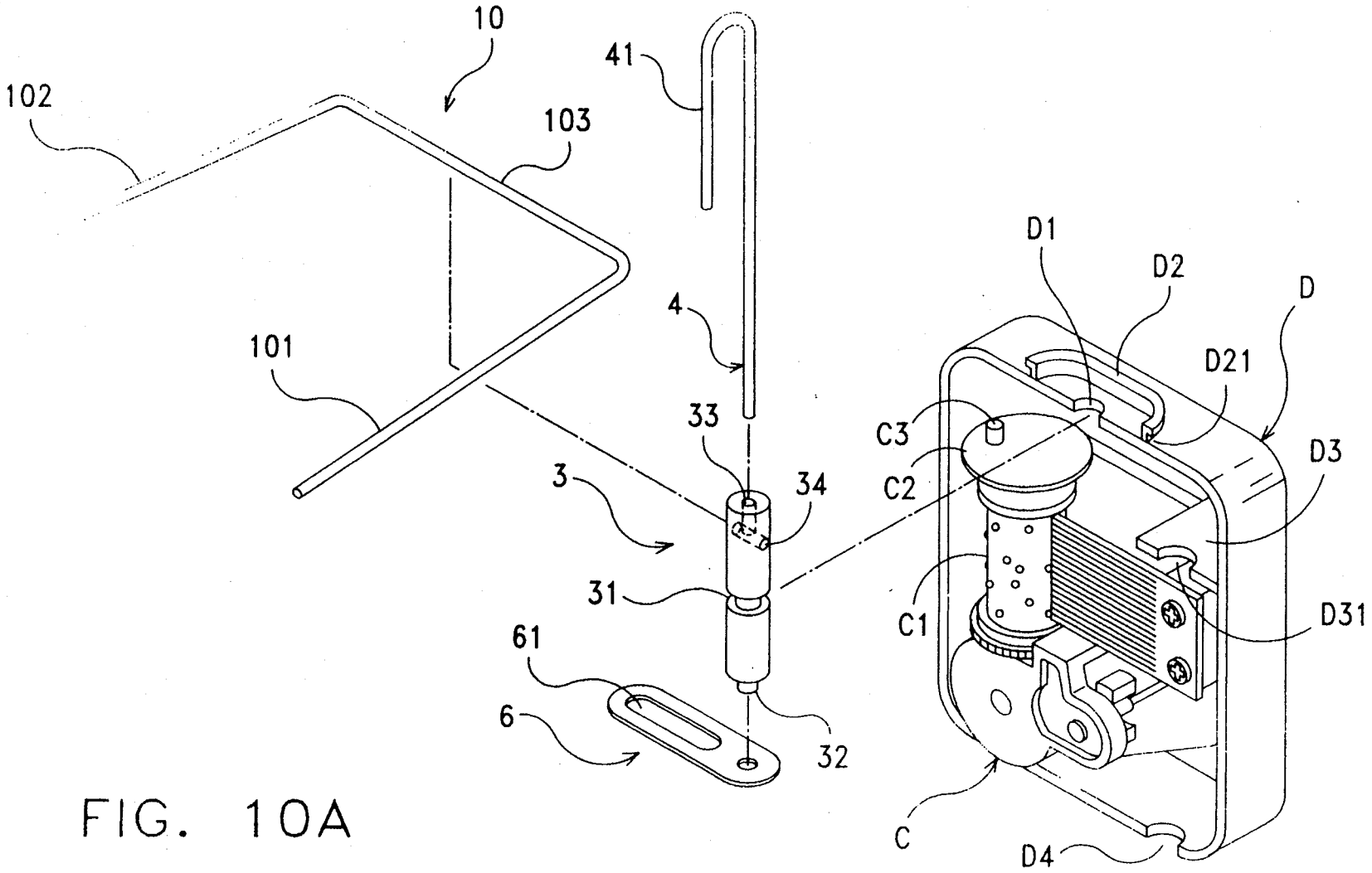
FIG. 10A is an exploded view of the music box transmission mechanism of FIG. 10.

Referring to FIGS. 10 and 10A, therein illustrated is still another alternate form of the present invention. This alternate form is comprised of a music box C, a coupling shaft 3, a link 6, a top actuating rod 4, and a substantially U-shaped swinging rod 10. The music box C, the coupling shaft 3, the link 6, and the top actuating rod 4 are similar to the corresponding parts shown in the aforesaid several embodiments. The swinging rod 10 is comprised of a middle rod portion 103 inserted through a side hole 34 on the coupling shaft 3 to stop the top actuating rod 4 from passing through the length of the coupling shaft 3 as the top actuating rod 4 is inserted into the center through hole 33 on the coupling shaft 3 from the top, two opposite end rod portions 101;102 respectively extended from two opposite ends of the middle rod portion 103 in the same direction. As the music box C is activated, the two opposite end rod portions 101;102 and the top actuating rod 4 are synchronously and horizontally turned back and forth. Therefore, the mechanism can simulate the action of a child in playing the game of hide-and-seek.

While only a few or embodiments of the present invention have been shown and described, it will be understood that various modifications and changes could be made without departing from the spirit and scope of the invention.

What is claimed is:

1. A music box transmission mechanism comprising:

a casing to hold a music reproducing mechanism comprised of a comb, a pinned barrel, and a clockwork, said casing comprising a top flange, a top notch, an outer groove on said top flange along the length, an inside bearing plate with a front notch, and a bottom notch;

a shell fastened to said casing at the top, said shell comprising two opposite side notches aligned on two opposite sides thereof, two stub pins on the inside, a bottom flange engaged into the outer groove on said top flange of said casing, a top through hole on a top thereof;

a base frame fastened to said shell on the inside, said base frame comprised of a horizontal portion and a vertical portion raised along one long side of said horizontal portion, said vertical portion comprising two round holes, into which said stub pins of said shell fit respectively, two racks bilaterally disposed on one side, said horizontal portion comprising a circular center hole in the center, two circular side holes on two opposite sides, and two half-round slots respectively disposed between the center hole and the side holes of said horizontal portion;

a movable plate disposed below said horizontal portion of said base frame, said movable plate comprising a circular center hole aligned with the circular center hole on said horizontal portion of said base frame, and two oblong side holes disposed on two opposite sides by the circular center hole thereof and respectively aligned with the half-round slots on said horizontal portion of said base frame;

a coupling shaft disposed below said movable plate, said coupling shaft comprising an annular groove fitted with the top notch on said casing, a bottom rod, a longitudinal center through hole, and a tightening up screw threaded through a side hole thereof into the longitudinal center through hole of said coupling shaft;

a connector connected to said horizontal portion of said base frame, said connector comprising a stepped bottom rod, a longitudinal center hole, and a tightening up screw threaded through a side hole thereof into the longitudinal center hole of said connector, said stepped bottom rod formed of a thicker rod section fitted into the center hole on said horizontal portion of said base frame and a thinner rod section extended from said thicker rod section and inserted through the center hole on said movable plate;

a link connected to said coupling shaft at the bottom, said link having one end connected to said coupling shaft and an opposite end formed into an oblong ring coupled to said pinned barrel; and characteristically having three maneuvering rods including a top actuating rod having a top end formed into a bend, and a bottom end inserted through the top round hole on said shell, the center through hole on said connector, and the center through hole on said coupling shaft and then fixed to said connector and said coupling shaft by the respective tightening up screw;

a right swinging rod comprised of a first horizontal rod portion disposed in horizontal and mounted on the respective side notch on said shell, a second horizontal rod portion extended from one end of the first horizontal rod portion of said right swinging rod at right angles on the same horizontal plane, and a vertical rod portion vertically extended from an opposite end of the first horizontal rod portion of said right swinging rod and disposed in vertical;

and a left swinging rod comprised of a first horizontal rod portion disposed in horizontal and mounted on the respective side notch on said shell, a second horizontal rod portion extended from one end of the first horizontal rod portion of said left swinging rod at right angles on the same horizontal plane, and a vertical rod portion vertically extended from an opposite end of the first horizontal rod portion of said left swinging rod and disposed in vertical;

whereby the vertical rod portion of each swinging rod is respectively inserted through either half-round slot on said horizontal portion of said base frame into the respective side hole on said movable plate so that said right and left swinging rods are alternatively and vertically reciprocated as the pinned barrel is activated by the clockwork.

2. The music box transmission mechanism of claim 1 wherein said right and left swinging rods are respectively coupled to said base frame and said movable plate by a respective crank so that said right and left swinging rods are turned back and forth horizontally as the pinned barrel is activated by the clockwork, the crank having one end connected to the vertical rod portion of either swinging rod and an opposite end inserted through the respective half-round slot on said horizontal portion of said base frame and the respective side hole on said movable plate.

3. The music box transmission mechanism of claim 1, whereby the vertical rod portion of said right swinging rod is inserted through the respective half-round slot on said horizontal portion of said base frame into the respective side hole on said movable plate, and the vertical rod portion of said left swinging rod is fitted into the respective side hole on said horizontal portion of said base frame.

4. The music box transmission mechanism of claim 1, whereby the vertical rod portion of said left swinging rod is inserted through the respective half-round slot on said horizontal portion of said base frame into the respective side hole on said movable plate, and the vertical rod portion of said right swinging rod is fitted into the respective side hole on said horizontal portion of said base frame.

5. The music box transmission mechanism of claim 1 wherein said right swinging rod is coupled to said base frame and said movable plate by a crank, and the vertical rod portion of said left swinging rod is inserted through the respective half-round slot on said base frame into the respective side hole on said movable plate, so that said right swinging rod is turned back and forth horizontally as said left swinging rod is reciprocated vertically.

6. The music box transmission mechanism of claim 1 wherein said left swinging rod is coupled to said base frame and said movable plate by a crank, and the vertical rod portion of said right swinging rod is inserted through the respective half-round slot on said base frame into the respective side hole on said movable plate, so that said left swinging rod is turned back and forth horizontally as said right swinging rod is reciprocated vertically.

7. The music box transmission mechanism of claim 1 wherein said right swinging rod is coupled to said base frame and said movable plate by a crank, and the vertical rod portion of said left swinging rod is fitted into the respective side hole on said horizontal portion of said base frame.

8. The music box transmission mechanism of claim 1 wherein said left swinging rod is coupled to said base frame and said movable plate by a crank, and the vertical rod portion of said right swinging rod is fitted into the respective side hole on said horizontal portion of said base frame.

9. The music box transmission mechanism of claim 1 which further comprises a bottom actuating rod coupled to said link at the bottom, said bottom actuating rod comprising an oval loop mounted around a rod on said link, a neck portion extended downward from said oval loop at one end and inserted into the bottom notch on said casing, and an elongated rod body connected to said neck portion and extended out of said casing.

10. A music box transmission mechanism comprising:

a casing to hold a music reproducing mechanism comprised of a comb, a pinned barrel, and a clockwork, said casing comprising a top flange, a top notch, and a bottom notch;

a shell spaced above said casing, said shell comprising a top through hole on a top thereof;

a base frame fastened to said shell on the inside, said base frame comprised of a horizontal portion and a vertical portion raised along one long side of said horizontal portion, said vertical portion comprising two round holes, into which said stub pins of said shell fit respectively, two racks bilaterally disposed on one side, said horizontal portion comprising a circular center hole in the center, two circular side holes on two opposite sides, and two half-round slots respectively disposed between the center hole and the side holes of said horizontal portion;

a movable plate disposed below said horizontal portion of said base frame, said movable plate comprising a circular center hole aligned with the circular center hole on said horizontal portion of said base frame, and two oblong side holes disposed on two opposite sides by the circular center hole thereof and respectively aligned with the half-round slots on said horizontal portion of said base frame; and specially having two coupling shafts including an upper coupling shaft disposed below said movable plate, said upper coupling shaft comprising an annular groove near a bottom end thereof fitted with the top notch on said casing, and a longitudinal center through hole;

and a lower coupling shaft aligned below said upper coupling shaft, said lower coupling shaft comprising a longitudinal center through hole, and a tightening up screw threaded through a side hole thereof into the longitudinal center through hole of said lower coupling shaft;

a connector connected to said horizontal portion of said base frame, said connector comprising a tightening up screw threaded through a side hole thereof into the longitudinal center hole of said connector;

a link connected to said lower coupling shaft at the bottom, said link having one end connected to said lower coupling shaft and an opposite end formed into an oblong ring coupled to said pinned barrel;

a top actuating rod having a top end formed into a bend, and a bottom end inserted through the top round hole on said shell, the longitudinal center through hole on said connector, the longitudinal center through hole on said upper coupling shaft, and the longitudinal center through hole on said lower coupling shaft and then fixed to said connector and said lower coupling shaft by the respective tightening up screw;

a right swinging rod comprised of a first horizontal rod portion disposed in horizontal and mounted on the respective side notch on said shell, a second horizontal rod portion extended from one end of the first horizontal rod portion of said right swinging rod at right angles on the same horizontal plane, and a vertical rod portion vertically extended from an opposite end of the first horizontal rod portion of said right swinging rod and disposed in vertical;

a left swinging rod comprised of a first horizontal rod portion disposed in horizontal and mounted on the respective side notch on said shell, a second horizontal rod portion extended from one end of the first horizontal rod portion of said left swinging rod at right angles on the same horizontal plane, and a vertical rod portion vertically extended from an opposite end of the first horizontal rod portion of said left swinging rod and disposed in vertical;

whereby the vertical rod portion of each swinging rod is respectively inserted through either half-round slot on said horizontal portion of said base frame into the respective side hole on said movable plate so that said shell is turned back and forth horizontally and said right and left swinging rods are alternatively and vertically reciprocated as the pinned barrel is activated by the clockwork.

11. The music box transmission mechanism of claim 10 wherein said right and left swinging rods are respectively coupled to said base frame and said movable plate by a respective crank so that said right and left swinging rods are turned back and forth horizontally as the pinned barrel is activated by the clockwork, the crank having one end connected to the vertical rod portion of either swinging rod and an opposite end inserted through the respective half-round slot on said horizontal portion of said base frame and the respective side hole on said movable plate.

12. The music box transmission mechanism of claim 10 which further comprises a bottom actuating rod coupled to said link at the bottom, said bottom actuating rod comprising an oval loop mounted around a rod on said link, a neck portion extended downward from said oval loop at one end and inserted into the bottom notch on said casing, and an elongated rod body connected to said neck portion and extended out of said casing.

* * * * *